US005291367A

United States Patent [19]

Rajewski

[11] Patent Number: 5,291,367

[45] Date of Patent: Mar. 1, 1994

[54] STACK IGNITER

[76] Inventor: Robert K. Rajewski, R.R. #1, Donalda, Alberta, Canada, T0B 1H0

[21] Appl. No.: 818,345

[22] Filed: Jan. 9, 1992

[30] Foreign Application Priority Data

Nov. 1, 1991 [CA] Canada ..... 2054810

[51] Int. Cl.[5] ..... F23Q 3/00

[52] U.S. Cl. ..... 361/253; 361/247; 431/202

[58] Field of Search ..... 361/247, 248, 249, 253, 361/255; 431/202, 264

[56] References Cited

U.S. PATENT DOCUMENTS 3,756,765 9/1973 Sparrow et al. .
4,147,493 4/1979 Straitz, III .
4,579,522 4/1986 MacDonald .

FOREIGN PATENT DOCUMENTS 1054508 5/1979 Canada .
1212618 10/1985 Canada .
1221728 5/1987 Canada .
1265431 2/1990 Canada .
1011558 9/1955 Fed. Rep. of Germany .

OTHER PUBLICATIONS

Mactronic Product Brochure, P.O. Box 621, Red Deer, Alberta, Canada, T6N 5G6.
Mactronic Ltd. Corporate Profile with 19 pages of drawings attached, Alberta, Canada, 1991.
Drawing of Sparrow Head, Sparrow Electric Ltd., Edmonton, Alberta, Canada, 1991.

*Primary Examiner*—Jeffrey A. Gaffin
*Attorney, Agent, or Firm*—Anthony R. Lambert

[57] ABSTRACT

An igniter for a flare stack includes a pair of probes. A hot probe has a tip end free to move in a substantially planar surface. A grounded probe has a tip end extending in at least one direction of the substantially planar surface. The hot probe also has a tip end extending in the substantially planar surface but in a different direction. Movement of the tip end of the hot probe in local wind conditions results in a constant gap being maintained between the tip ends. The pulse generator for the igniter is conventional. A system is shown for stack 90' and shorter and for stacks higher than 90'.

4 Claims, 8 Drawing Sheets

STACK IGNITER

FIELD OF THE INVENTION

This invention relates to igniters for flare stacks used to flare gas from oil wells.

BACKGROUND AND SUMMARY OF THE INVENTION

In many oil wells, gas is dissolved in the oil and when the oil comes to the surface and is exposed to the lower pressure at the surface, the gas bubbles out of the oil. Frequently this gas is not present in the oil in sufficient quantities to warrant storage or transportation of the gas to a pipeline. Since the gas is often sour (contains hydrogen sulphide) and itself may be harmful, regulations require that the gas be burned at the oil well. This process is known as flaring the gas.

To enable the gas to be burned at a safe distance from the oil well itself and to avoid a fire hazard near the ground, the gas must be burned at a relatively high point above the ground. For this purpose, flare stacks are used. These flare stacks may be over 90' high and consequently are exposed to high winds, with the result that the flares frequently go out and require re-igniting.

Ignition itself can be difficult. If a fixed spark gap is used, the spark gap can become corroded and eroded, with the consequence that the spark may be insufficient to re-ignite the flare, particularly in high winds. The inventors have proposed the use of a flexible spark probe (hot electrode) in which a constant gap is maintained between the hot electrode and the grounded electrode even though the flexible probe may be vibrating in the wind.

There is therefore proposed in one aspect of the invention an igniter comprising:

- a first probe having a first tip end that may move in normal wind conditions in a substantially planar surface;
- a second probe having a second tip end;
- one or both of the first and second tip ends being extended at least in a direction parallel to the planar surface, the first tip end being disposed adjacent the second tip end;
- whereby upon movement of the first tip end, a substantially constant gap is formed between the first tip end and the second tip end.

Preferably, the second tip end is linear and the first tip end is extended in a direction in the planar surface at an angle to the second tip end, whereby upon movement of the first tip end in the planar surface, a substantially constant gap is formed between the first tip end and the second tip end.

The invention also provides means for mounting the igniter and means for providing an electric pulse to the igniter to form an ignition system.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
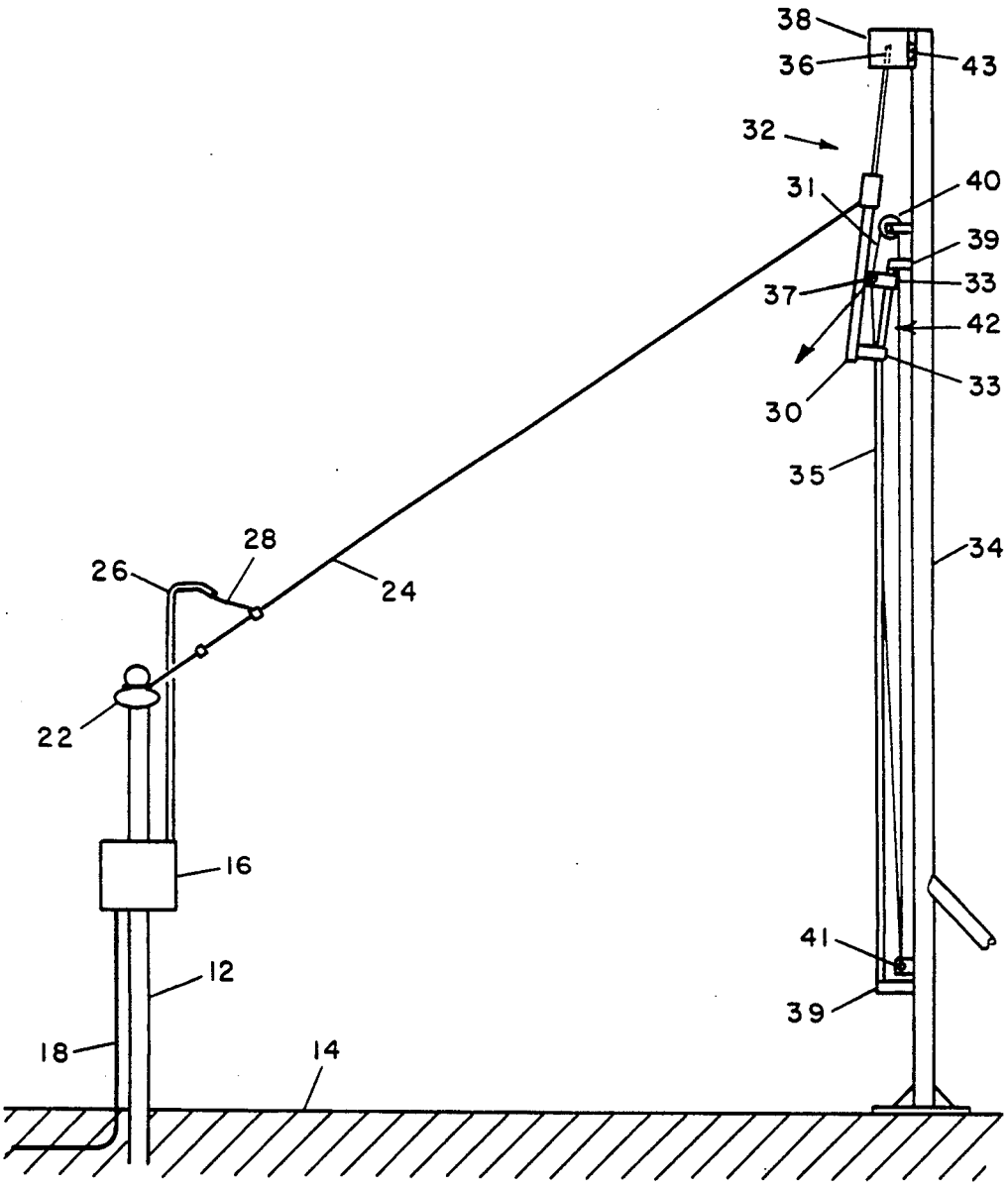
FIG. 1 is a schematic of an ignition system according to the invention for use with flare stacks 90' or shorter.

Referring to FIG. 1 there is shown a general arrangement for an ignition system for a flare stack that is 90' high or shorter. Mounting pole 12 is secured to the ground 14. Control and battery power source enclosure 16, which is of conventional construction, is mounted on the pole 12 with a connecting 110 VAC or solar power supply cable 18. At the top end of the pole 12 is an insulator 22 to which is connected a high voltage ⅛" diameter stainless steel cable 24. A PVC pipe 26 extends upwardly from the control enclosure 16. A hot ignition wire 28 extends from the control enclosure 16 through the PVC pipe 26 to the high voltage cable 24.

The high voltage cable 24 runs out to the igniter 32 mounted on the flare stack 34. The igniter 32 is provided with a retractable mounting system 42 for moving the igniter up and down on the flare stack 34. The retractable mounting system includes a frame 30 made from 4" stainless steel pipe, and a pair of tracking runners 33 on the frame. The tracking runners 33 slide on rails 35 attached by bars 39 to the flare stack 34. A top hole 37 at the upper of the two tracking runners fixedly receives a cable 31 that passes through a pulley 40 and runs down to and through a hole 41 back to the hole 37.

The tip ends 36 of the igniter 32 extend into a wind shroud 38 mounted on the top of the flare stack 34 in conventional fashion. The shroud forms an enclosure (6" wide, 12" tall, 10" deep) around an oval opening 43 in the tubing of the flare stack near the top of the flare stack. The shroud is open at the top and the bottom. The tip ends 36 are located adjacent the opening 43 in the flare stack.

Figure 2:
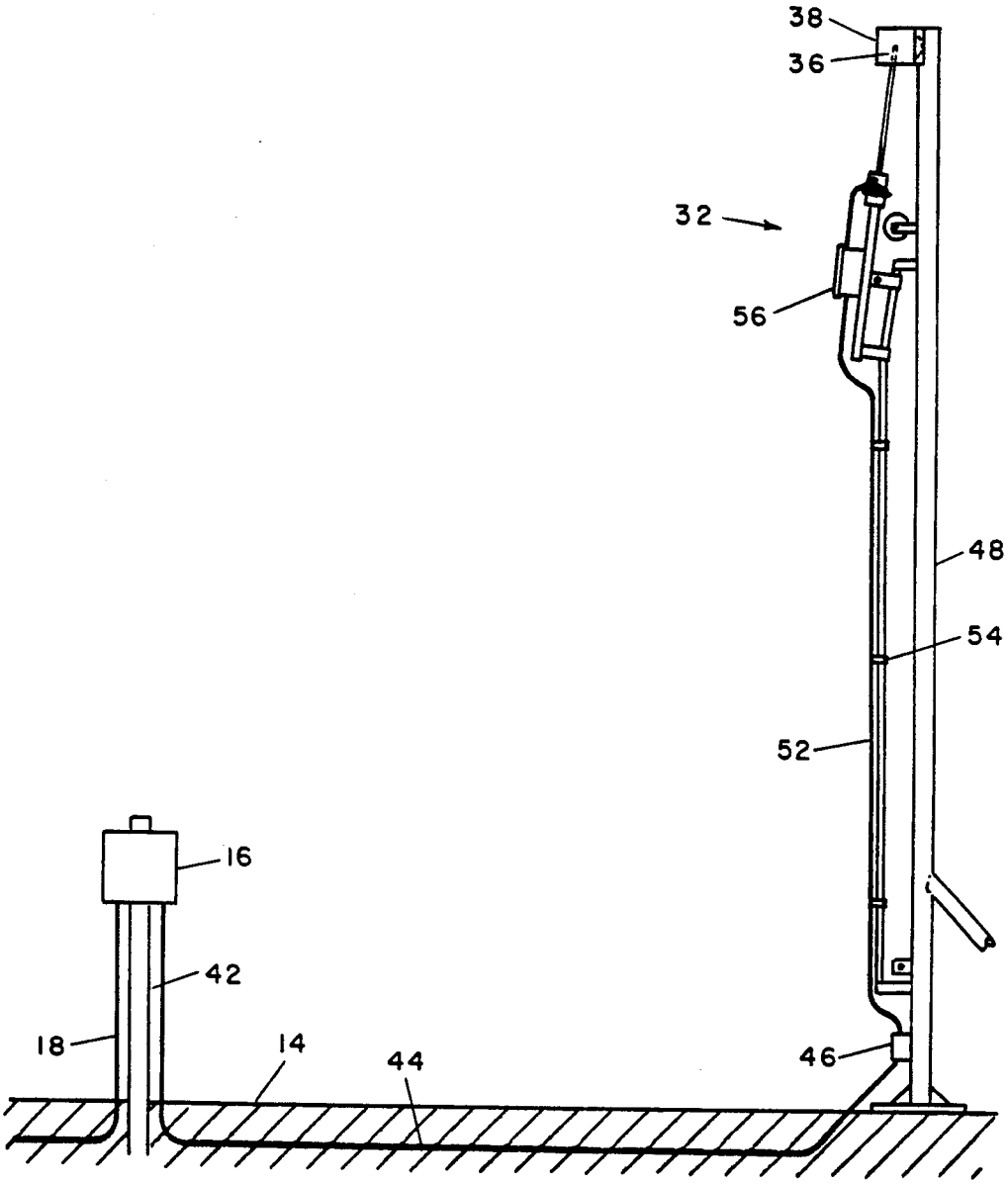
FIG. 2 is a schematic of an ignition system according to the invention for use with flare stacks higher than 90'.

Referring to FIG. 2, there is shown an ignition system for a flare stack higher than 90". Control enclosure 16 is mounted on a shorter mounting pole 42 with power supply cable 18. A cable 44 (for example #16/3 Teck TM cable commonly commercially available for example from Westburn Electric of Red Deer, Alberta, Canada) runs from the control enclosure 16 out to an electrical junction box 46 mounted near the ground on the flare stack 48. A #16/3 SOW cable 52 (also available for example from Westburn Electric) mounted on the flare stack 48 with stabilizers 54 runs up to a transformer 56 mounted on the igniter 32. The tip ends 36 of the igniter 32 extend into a shroud 38 mounted on the top of the flare stack 48.

Figure 3:
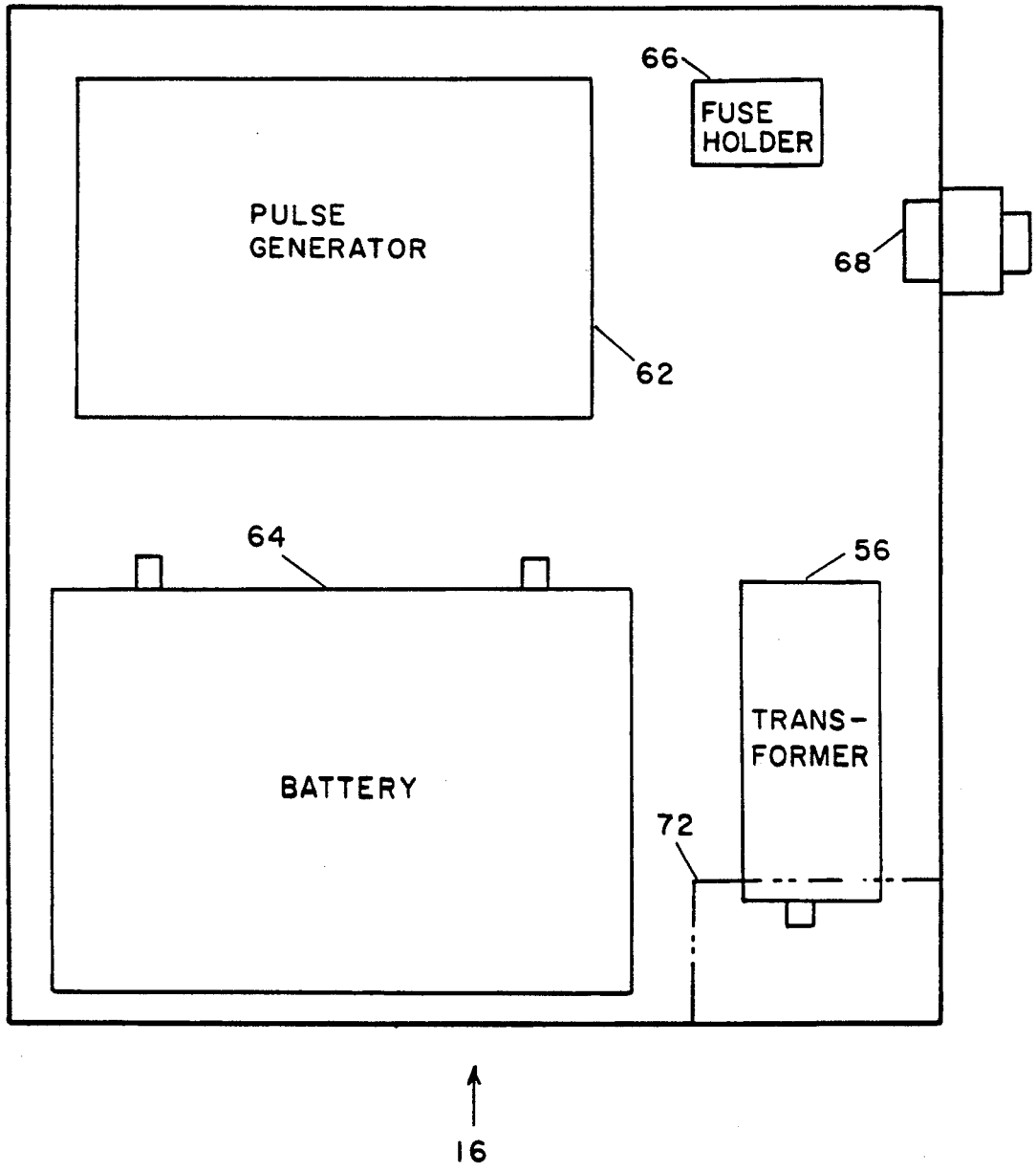
FIG. 3 is a block diagram of a control and power source for the ignition system shown in FIG. 1.
Figure 4:
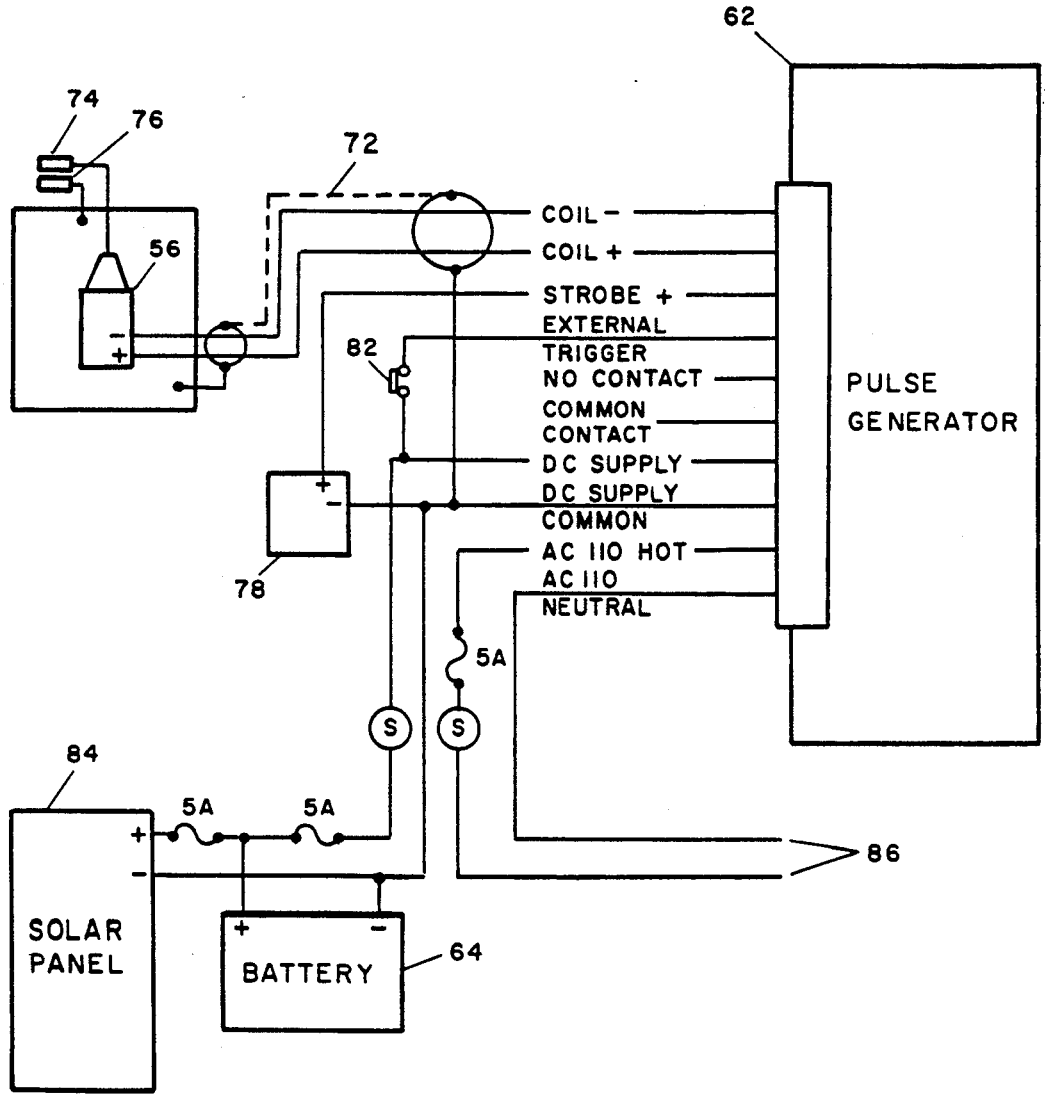
FIG. 4 is a wiring diagram for the control and power source shown in FIG. 3.

FIG. 3 shows a block diagram of the control enclosure 16. The enclosure is 16"×14"×6" and houses an electronic pulse generator or igniter 62, which may be readily designed for the purpose described here but is preferably model 9008 available from BR Consulting Limited from Penhold, Alberta, Canada, a 12V/28A dry fit A200 battery 64, a fuse holder 66, manual on-off switch 68 and transformer 56 with shield 72. The wiring for the control enclosure 16 is shown in FIG. 4. The pulse generator 62 outputs on two leads to the transformer 56 mounted on shield 72. It is important that the shield be properly grounded and that the output from the pulse generator 62 be connected to the appropriate coils of the transformer 56 (see FIG. 4). The transformer 56, see FIGS. 1, 2 and 3, is externally mounted on stacks higher than 90" and mounted in the control enclosure 16 on stacks 90" and lower. The transformer 56 outputs on two leads to the electrodes or probes 74 and 76 of the igniter 32. A strobe 78 may be connected to the pulse generator 62 for testing purposes. Normally the pulse generator 62 operates automatically but may be operated manually by manual trigger 82. DC power supply input to the generator 62, strobe 78 and for the transformer 56 is provided by battery 64. AC supply 86 or a solar panel 84 may be used to recharge the battery 64. Switches marked S on the power supply leads may be used to turn the system on and off. Fuses (5 amp) as shown are also recommended on the power supply leads.

Figure 5:
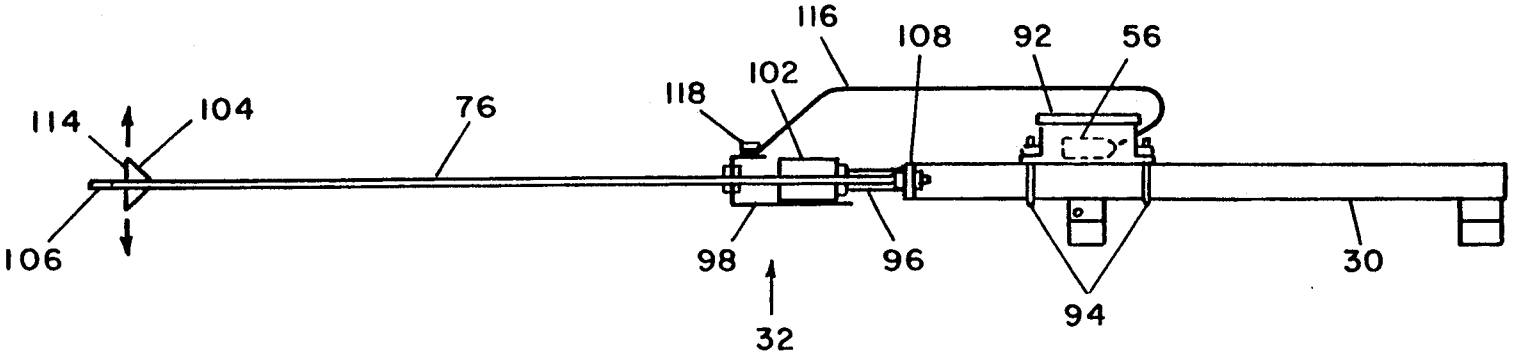
FIG. 5 is a side view schematic of an igniter according to the invention.
Figure 6:
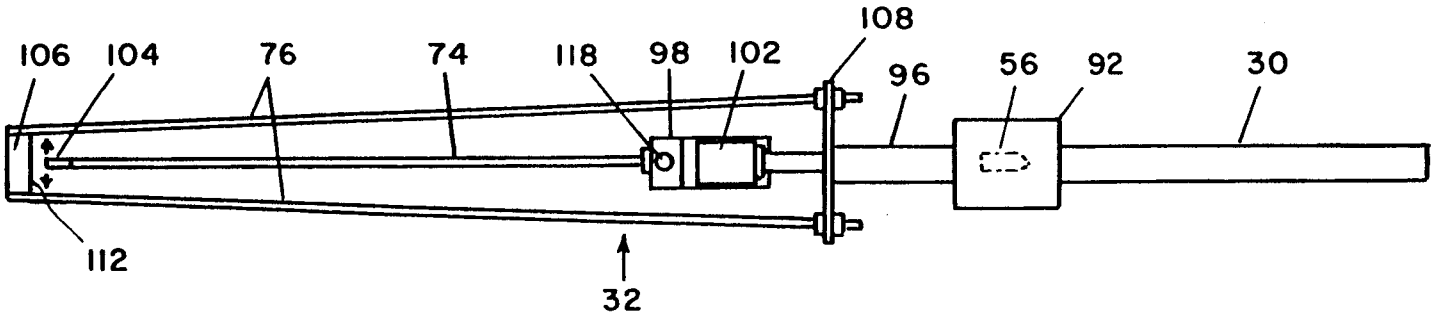
FIG. 6 is a top view schematic of the igniter shown in FIG. 5.

Referring to FIGS. 5 and 6, there is shown an igniter for use with the ignition system described in relation to FIGS. 2, 3 and 4. The igniter 32 includes a frame 30 described above in relation to FIG. 1 and a transformer 56 mounted in an enclosure 92 on the frame 30 by U-bolts 94. A ¾" stainless steel rod 96 extends from the frame 30 into a stainless steel insulator housing 98. An insulator 102 is mounted on the stainless steel rod 96 and secured to the housing 98. The insulator and insulator housing are described in more detail below in relation to FIG. 10. A single hot electrode or arc probe 74 is clamped to and extends from the insulator housing 98. The end of the hot probe 74 that is secured to the insulator housing is preferably threaded and screws into a ¾" nut 107 which is secured against the insulator housing to secure the hot probe 74. The tip end 104 of the hot electrode 74 is free to move in a two dimensional surface approximately defined by a spherical surface having a radius equal to the length of the hot probe 74 and a centre at the point of attachment of the hot probe 74 to the housing 98 (at the nut 107), and will be free to move in that spherical surface except to the extent of being constrained by its attachment to the insulator housing. For any reasonable length of probe (preferably about 4' long) the spherical surface will essentially be planar over the distance of interest, namely about 3" as defined by the distance between the two grounded probes at their tip end 106. The two grounded probes 76 are clamped on bracket 108 that is fixed to the frame 30 and extend on either side of the hot probe 74 to a point just beyond the tip end 104 of the hot probe 74.

The tip end 106 of the pair of grounded probes 76 extends at least in a first direction parallel to the plane of movement of the hot probe 74 to form a first linear arcing surface 112. In FIG. 5 the linear arcing surface 112 is perpendicular to the plane of the Figure, and in FIG. 6 the linear arcing surface is parallel to the plane of the Figure.

The tip end 104 of the hot probe preferably extends linearly approximately parallel to the planar surface between the two grounded probes to form a second linear arcing surface 114 that is preferably approximately perpendicular to the direction of the first linear arcing surface 112. That is the second linear arcing surface is parallel to the plane of FIG. 5 and perpendicular to the plane of FIG. 6, and thus as shown the first and second linear arcing surfaces are perpendicular to each other.

Figure 7:
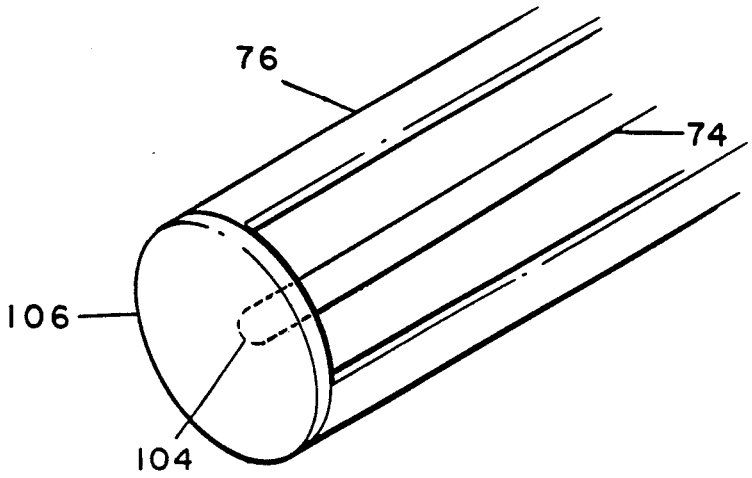
FIG. 7 shows another embodiment of a tip of a grounded electrode for use with the invention.
Figure 8:
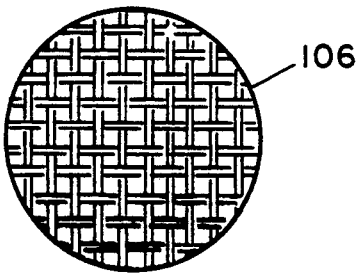
FIG. 8 shows a still further embodiment of a tip of a grounded electrode for use with the invention.

It is possible that the tip end 106 may extend in a plane as shown in FIG. 7, in which case the tip end 104 need only be a point, or vice versa. However, if either the tip end 104 or the tip end 106 has a planar surface, this impedes the flow of gas and is not preferred. In the embodiment shown in FIG. 8 the tip end 106 may form a grid extending in a plane, but again this is not preferred. In the embodiment shown in FIG. 8, the probe 74 would have a pointed tip as shown in FIG. 7.

The inner probe 74 may be grounded and the outer probes 76 may be made the hot probes, but this is not desired due to safety reasons. In the example shown the first arcing surface forms a straight line and is not curved, but with the length of probe proposed, this will result in a substantially constant gap maintained between the first and second tip ends. With a short length of hot probe 74, the arcing surface may be made slightly curved to conform to the surface of vibrational movement of the tip end 104.

An ignition wire 116 runs from the transformer 56 to a stainless steel clamp 118 on the insulator housing 98. The ignition pulse therefore runs from the transformer through the wire 116, clamp 118 and housing 98 to the hot probe 74.

Figure 10:
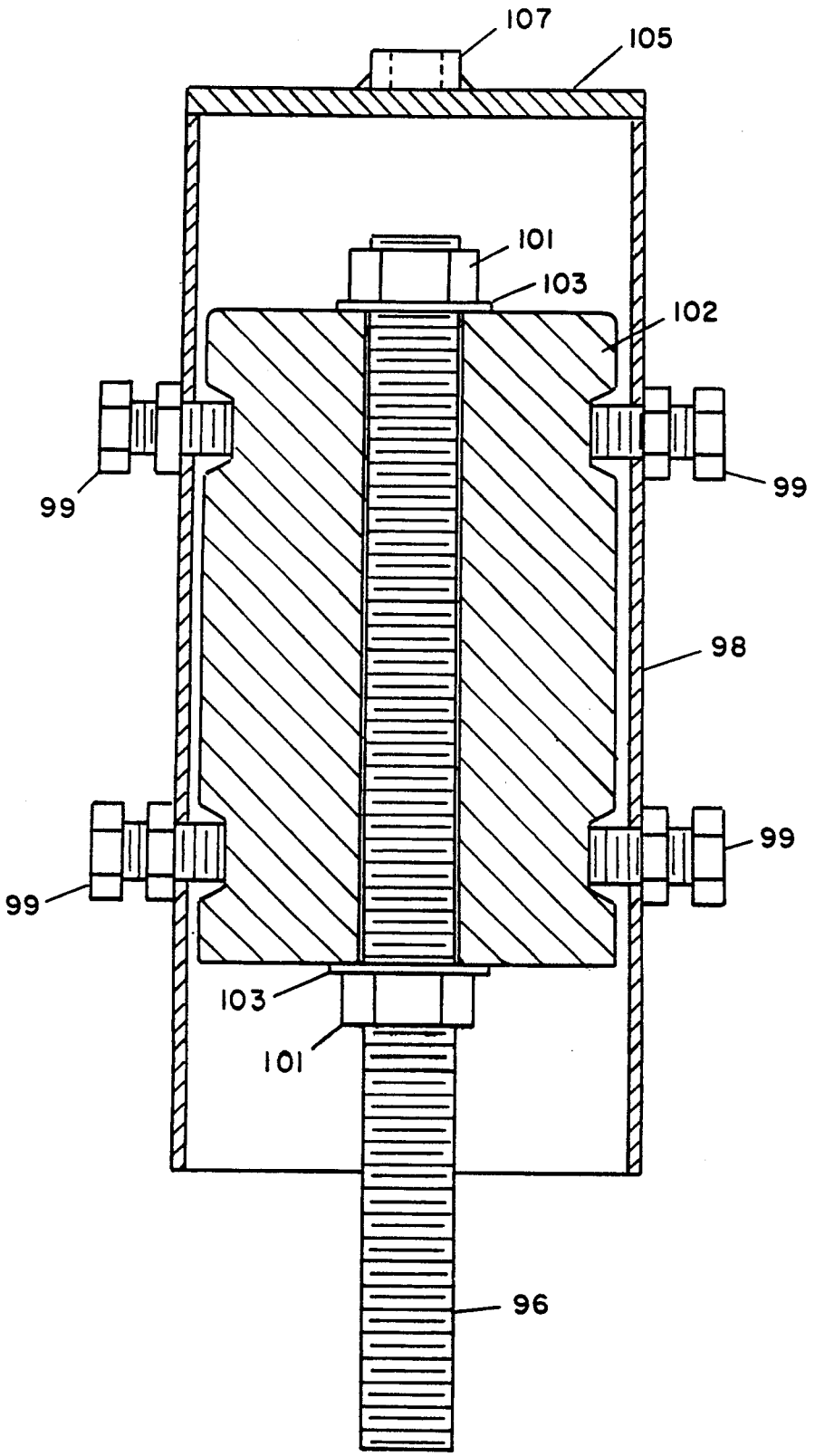
FIG. 10 shows a detail of an insulator and insulator housing for use with a stack igniter according to the invention.

Referring to FIG. 10, there is shown a detail of the insulator housing 98 and the insulator 102. The insulator 102 is made preferably from alumina ceramic (95% alumina) available from for example Indepor of Medicine Hat, Alberta, Canada, and includes two circumferential recesses formed around it near its upper and lower ends. These recesses each receive four bolts 99 (four upper and four lower ½"×1" steel bolts) that are distributed around the insulator 102 and hold the insulator 102 in place within the housing 98. The bolts 99 pass through holes in the insulator housing 98. The ⅞" all thread rod 96 extends through the insulator 102. The insulator 102 is secured on the rod 96 by lock nuts 101 and washers 103. The housing 98 is formed from a 4" 304 stainless steel pipe with a ¼" plate 105 at one end. A ½" nut is welded to the plate 105 for attachment of the hot probe 74.

Figure 9:
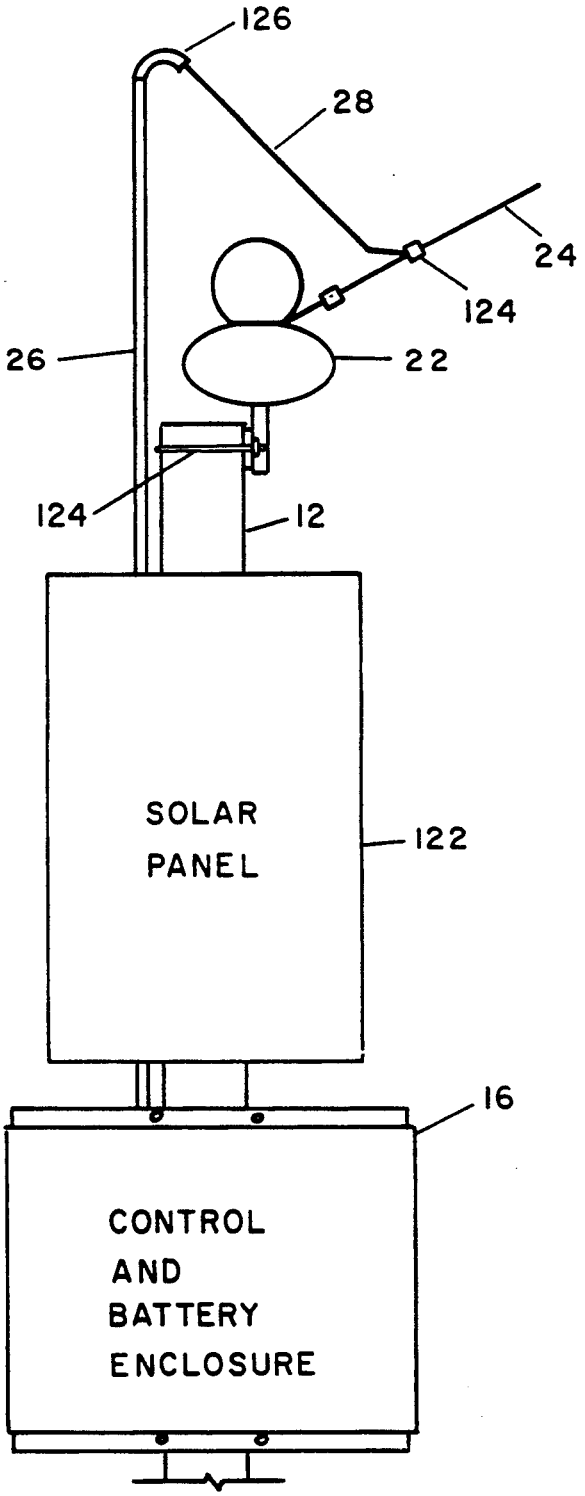
FIG. 9 is a detail of a control mount for the ignition system shown in FIG. 1.

Referring to FIG. 9, there is shown a detail of the control enclosure mount. The control enclosure 16 mounts on the pole 12, and as shown includes a solar panel 122. An insulator 22 is mounted on the pole 12 with a U-bolt 124. A PVC pipe 26 extends from the enclosure 16 and terminates in a weather cap 126. The hot ignition wire 28 runs up the pipe 26 and connects to the high voltage cable 24 at connecting block 128.

The igniter operates as follows. The pulse generator 62 supplies pulses of electrical energy to the hot probe 74. The electric pulses jump across the spark gap between the tip end 104 and the tip end 106. The duration, voltage and frequency of the pulses is set by the pulse generator and may be chosen by the operator in known fashion. Gas moving in the flare stack will spill over into the shroud (either through the hole 43 or over the top of the flare stack) where it will mix with the ambient air in the shroud. The spark will ignite the gas in the shroud and the flame will travel to the top end of the flare stack where the gas exiting the flare stack will burn. With fixed probes, the series of pulses applied to the hot probe will spark in the same place with resulting corrosion and loss of oxygen from pulse to pulse so that the spark will find it difficult to ignite the gas. With the flexible hot probe of the present invention, the moving tip end (it moves in the wind) will ignite gas at different locations from pulse to pulse so that each pulse and hence each spark may find fresh gas and oxygen to ignite. The configuration of the tip ends ensures that a substantially constant gap is maintained for the spark to jump across. The length, thickness and mounting of the hot probe should be chosen so that the vibrational movement of the probe in normal wind conditions is sufficient to move the probe between sparks, but not so much that the hot probe contacts the grounded probes. Normal wind conditions means between about 6 mph and 30 mph. Movement of about ½" in light winds is desired. In the preferred embodiment described, the pulses should be produced in bursts with burst duration set to about 1.5 seconds with delay between bursts of about 40 seconds. The gap between the tip ends is about ¼". The voltage supplied should be about 23,000 to 25,000 volts. Pulse frequency during bursts should be about 80 per second.

In operation, the operator should ensure that the outer probes 76 do not touch the shroud 38 and that the inner probe 74 does not touch the outer probes 76. As with any electrical equipment, all connections should be checked for damage, loose connections, shorting and proper grounding.

For installation, the igniter 32 should first be mounted on the retractable mounting system 42, and the high voltage cable (24 in FIG. 1, 52 in FIG. 2) should be connected to the clamp 118 on the insulator housing 98 (FIG. 1) or to the transformer 56 (FIG. 2). The igniter 32 should then be mounted on the retractable mounting system using the cable 31. The tip ends 36 of the probe should be centered in the shroud 38. The control enclosure 16 should then be mounted on the post 12, with the insulator on top of the post 12. The PVC pipe should than be mounted on the post 12 with the weather cap 126 about 12" above the top of the insulator assembly. If the system is to be solar powered, then the solar pack should be mounted above the control enclosure 16. In the case of the igniter shown in FIG. 1, the high voltage cable 18 should be attached to the insulator through the two connecting blocks 128 and wrapped twice around the insulator 22 then bolted to the insulator. The ignition wire 28 should be connected to the high voltage cable 24 at one of the connecting blocks 128. The connector block 128 is preferably set up away from the enclosure so that any oil or water on the cable 24 drips off and onto the ground and not onto the control enclosure 16 or solar panel 122. All wiring should be connected as shown in FIG. 4, with the system ground by a wire connected from a ground lug on the control enclosure 16 to a winch mount bolt on the flare stack. The equipment may be then turned on.

ALTERNATIVE EMBODIMENTS

A person skilled in the art could make immaterial modifications to the invention described and claimed in this patent without departing from the essence of the invention.

I claim:

1. An igniter comprising:

a first probe having a first tip end forming a first linear arcing surface that may move in normal wind conditions in a substantially planar surface;

a second probe having a second tip end forming a second linear arcing surface at an angle to the first tip end;

the first tip end being disposed adjacent the second tip end;

whereby upon movement of the first tip end, a substantially constant gap is formed between the first tip end and the second tip end.

2. The igniter of claim 1 in which the first and second linear arcing surfaces are substantially perpendicular to each other.

3. The igniter of claim 1 forming an ignition system in combination with:

means for mounting the first and second probes adjacent a fuel source to be ignited; and means for providing an ignition pulse to the first probe.

4. The igniter of claim 3 in which the first and second linear arcing surfaces are substantially perpendicular to each other.

* * * * *